US005788046A

United States Patent [19]

Lamah

[11] Patent Number: 5,788,046

[45] Date of Patent: Aug. 4, 1998

[54] METHOD FOR RECOGNIZING COINS AND APPARATUS THEREFOR

[75] Inventor: Ahmad Lamah, Dublin, Ireland

[73] Assignee: Austel Licensing GmbH, Salzburg, Austria

[21] Appl. No.: 605,207

[22] PCT Filed: Mar. 4, 1995

[86] PCT No.: PCT/EP95/00803

§ 371 Date: Nov. 15, 1996

§ 102(e) Date: Nov. 15, 1996

[87] PCT Pub. No.: WO95/24024

PCT Pub. Date: Sep. 8, 1995

[30] Foreign Application Priority Data

Mar. 4, 1994 [DE] Germany ..... 9403691 U
Mar. 14, 1994 [IE] Ireland ..... 940226

[51] Int. Cl.[6] ..... G07D 5/02

[52] U.S. Cl. ..... 194/317; 194/334

[58] Field of Search ..... 194/317, 328, 194/334

[56] References Cited

U.S. PATENT DOCUMENTS

| | | | |
|---|---|---|---|
| 4,509,633 | 4/1985 | Chow | 194/334 |
| 4,565,275 | 1/1986 | Hagiwara | 194/334 X |
| 4,585,936 | 4/1986 | Sellier | 194/334 X |
| 4,646,904 | 3/1987 | Hoormann | 194/334 |
| 5,033,603 | 7/1991 | Kai et al. | 194/334 |
| 5,067,604 | 11/1991 | Metcalf | 194/203 |
| 5,392,892 | 2/1995 | Mulder | 194/334 |

FOREIGN PATENT DOCUMENTS

| | | |
|---|---|---|
| A-1 206 618 | 6/1986 | Canada . |
| A-0 078 214 | 5/1983 | European Pat. Off. . |
| A-0 101 276 | 2/1984 | European Pat. Off. . |
| A-0 483 451 | 5/1992 | European Pat. Off. . |
| A-2 353 911 | 12/1977 | France . |
| A-39 10 824 | 11/1989 | German Dem. Rep. . |
| A-34 16 045 | 10/1985 | Germany . |
| A-2 174 227 | 10/1986 | United Kingdom . |
| WO-A-92/09056 | 5/1992 | WIPO . |

*Primary Examiner*—F. J. Bartuska
*Attorney, Agent, or Firm*—Oliff & Berridge, PLC

[57] ABSTRACT

A method for recognizing permitted and prohibited coins permits precise and trouble-free assignment of coins by a procedure in which, during a learning step, characteristic values of reference coins are determined without contact and the measured values of coins to be investigated are compared with the characteristic values. The measured values are determined during rolling of the coins through a chute (6). Light barriers (204*a–e*, 205*a–e*) which determine blocking times when the coins roll through are used for the measurement.

32 Claims, 6 Drawing Sheets

METHOD FOR RECOGNIZING COINS AND APPARATUS THEREFOR

The invention relates to a method according to claim 1 and to an apparatus according to claim 19.

There are various known methods and apparatuses for recognizing permitted and prohibited coins. In the case of the widely used multi-slot automatic machines, separate coin slots are provided for the various permitted coins, so that the coins must be inserted into the correct slots. In order to increase the user-friendliness, devices having only one coin slot for all coins were developed. The various coins are separated mechanically on the basis of size and, if necessary, weight of the coins. However, with mechanical separation it is not possible to guarantee sufficiently good recognition of false coins. Furthermore, good mechanical separation is not sufficiently rapid and, owing to the necessary contacts, tends to cause blockage.

In order to detect coins better and more rapidly on the basis of the diameter and of the material or of their electromagnetic properties, a measuring method has been described in which the coins pass through an alternating magnetic field of a first coil. The induction voltage induced by the alternating magnetic field and changed by a coin passing through the alternating field is measured with a second coil. The induction voltage curve depends on the coin size, on the electromagnetic properties of the coin and on the velocity of passage.

Since the coin properties act cumulatively on the measured induction voltage, it is possible that different coins cause essentially the same change to the induction voltage curve and thus cannot be separated from one another. The extent to which the induction changes caused by different coins differ from one another also depends on the frequency of the alternating magnetic field used. The fact that a frequency tuned to the expected permitted and prohibited coins has to be chosen is therefore a disadvantage of this method. For increasing the accuracy of differentiation, the known apparatus provides two alternating magnetic fields having different frequencies and accordingly two induction coils. Not only is a substantially more complicated apparatus necessary as a result but also the analysis is made very complex owing to the evaluation of frequency-dependent differences.

The measurement of a small change in the induction voltage is very susceptible to interference, particularly close to electric circuits and in apparatuses having metallic parts. In addition, there is a danger that a permitted coin may be simulated by an interfering electromagnetic signal.

It is therefore the object according to the invention to describe a method and an apparatus which permits coins of any currencies to be recognized as permitted or prohibited at little expense and with high reliability by means of a non-contact measurement.

The object according to the invention is achieved by the process features of claim 1 as well as by the apparatus features of claim 19.

The learning step envisaged in the method according to the invention permits simple and universal use of the method since the input of reference coins determines characteristic values which can be compared with the corresponding values of the coins to be tested. If the result of the comparison is within predetermined limits, the tested coin is classed as permissible. To ensure reliable coin classification, the one or more properties investigated by means of a measurement belong to a group which consists of coin diameter, coin thickness, coin material, coin surface, coin weight, air resistance and/or rolling resistance of the coin and generally of the coin rolling behaviour in an inclined chute.

The coins are fed into an apparatus via a feed means having a coin slot from which the coins, preferably in a predetermined state of movement, reach a chute which is coordinated with a sensor unit. At least one sensor of the sensor unit determines, during the rolling process, a measured value which depends on coin properties and chute properties. The sensor unit is connected to an electronics unit which comprises at least one processor and one memory and permits the acquisition of measured values, the storage of characteristic values and the comparison of measured with characteristic values. Depending on the result of the comparison, the electronics unit controls a trigger means which is located at the end of the chute and can guide the coins into at least two separate sections.

The sensor unit preferably comprises at least one light barrier which guides radiation in the visible or invisible range, but preferably in the infrared range, across the chute so that the light path from the transmitter to a coordinated receiver can be blocked by coins which roll through the chute. Whether the light barrier is blocked or not depends on whether the coin diameter is greater or smaller than the distance from the light barrier to the running surface of the chute.

By arranging at least two light barriers at different distances from the running surface, it is possible with little effort to classify the coins in diameter classes which are determined by the distances of the light barriers from the running surface. By virtue of the fact that the light barriers not only detect a blockage but also measure the time of the blockage, a sufficiently large number of light barriers results in a set of blocking times which characterize the diameter and the rolling behaviour of the coins so that an exact differentiation between permitted and prohibited coins is possible. A set of light barriers and the processor required to operate the light barriers can be assembled economically and with little effort. Light barriers have the further advantages that they are not susceptible to faults, set no requirements with regard to the material in their environment and furthermore are not influenced by interfering signals from outside.

The coin values of permitted coins are preferably summed during an insertion cycle by at least one accumulator so that the value of the permitted inserted coins is known. Via the connection to the processor, the accumulator value is passed on and/or reset to an initial value.

If the velocity of movement v at which a coin moves in the longitudinal direction of the chute and the blocking time $t_1$ at a distance $h_1$ from the running surface are known, the coin diameter can be calculated exactly as $$D=h_1+v^2\cdot t_1^2/4h_1.$$

To determine the velocity of movement, preferably at least two light barriers are arranged at the same distance from the running surface. When a coin passes through, the front coin edge in the direction of movement and/or the rear coin edge can then be used as a trigger for a time measurement during the movement of the coin from the first to the second light barrier. The quotient of the distance between the two light barriers and the measured time of movement corresponds to the velocity of movement. If the time of movement is measured for both edges, two velocities, a mean velocity and an acceleration can be determined. In addition to the time of movement, preferably the blocking time in the case of one light barrier and/or two light barriers is also determined. The coin diameter and an important piece of information on the rolling process of the coin are obtained from the two velocities and the two blocking times. These values, or at least part of these values or values derived therefrom, are thus stored as characteristic values for reference coins. Further characteristic values can be determined by further pairs of light barriers at the same distance.

Particularly in the case of a defined initial velocity of the coin at the upper chute beginning, the two velocities measured in the region of the measuring unit depend substantially on the mass of the coin, the frictional forces and the coin diameter which can be determined, and on the known magnitudes of the chute inclination and the measuring position in the chute. The chute is preferably inclined at not less than 10°, in particular at about 25°, relative to the horizontal. In order to ensure a defined initial velocity, the feed means preferably comprises a brake means and/or in particular an impact plate at which the inserted coins are deflected.

To permit simple measurement of the blocking times and/or of the times of movement, the light barriers are preferably operated with pulsed radiation so that the blocking time can be determined by counting light pulses which have been transmitted but not received and the time of movement can be determined by counting pulses which are blocked only at one light barrier. The pulse frequency used is preferably at least 1000 Hz, in particular about 1500 Hz. Integrators can of course also be used for the time measurement, in particular in conjunction with constant light.

In order to obtain information about the material and, for example, the surface structure of the coins, a capacitor having capacitor plates arranged on both sides of the chute is, if required, used as a sensor. Capacitance changes during passage of the coins are measured for this purpose. The capacitor, preferably as part of an oscillating circuit, detunes a periodic signal which has a frequency of at least 1000 Hz, in particular about 1500 Hz.

The invention is described in detail below with reference to the drawings:

FIG. 1 shows an assembly drawing of a coin receiver;

FIGS. 2*a* and 2*b* shows a possible arrangement of sensors for checking coins in a receiver according to FIG. 1;

Figure 3:
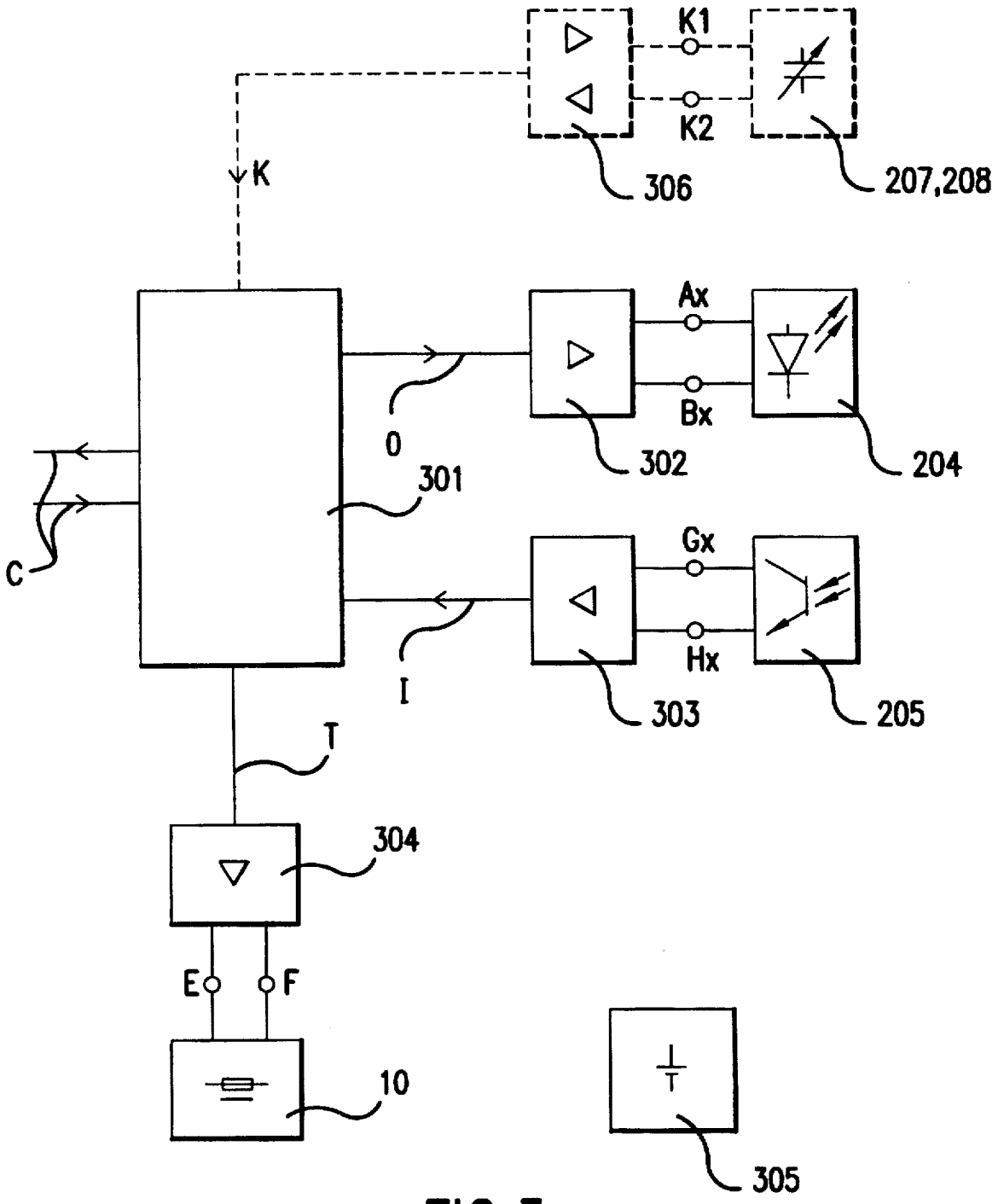
FIG. 3 shows a block circuit diagram of an electronics unit of a coin receiver according to FIG. 1.
Figure 4:
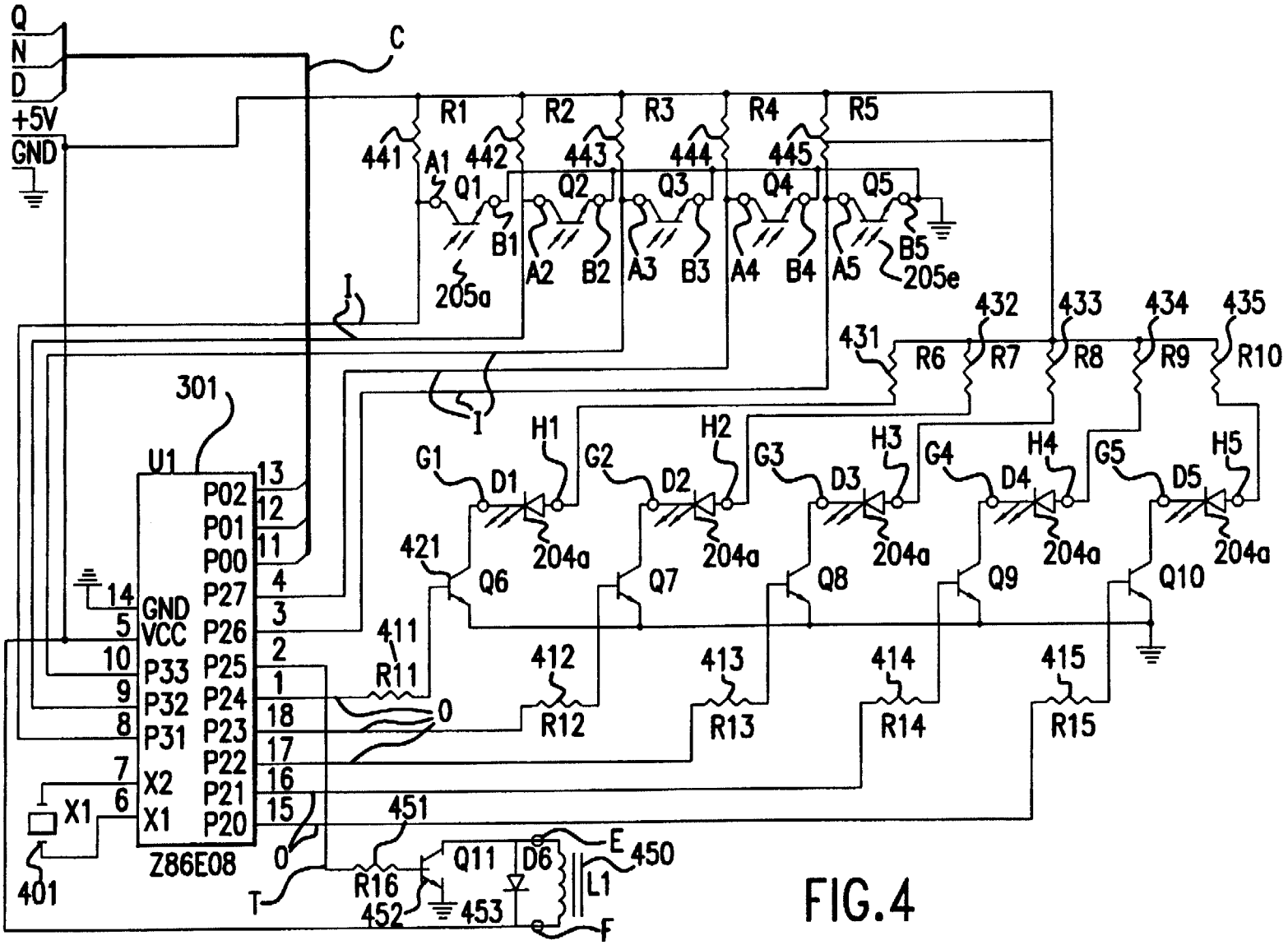
FIG. 4 represents an exemplary total circuit diagram of the electronics unit of a coin receiver and FIG. 5 illustrating a signal pattern of an arrangement according to FIG. 4.
Figure 6:
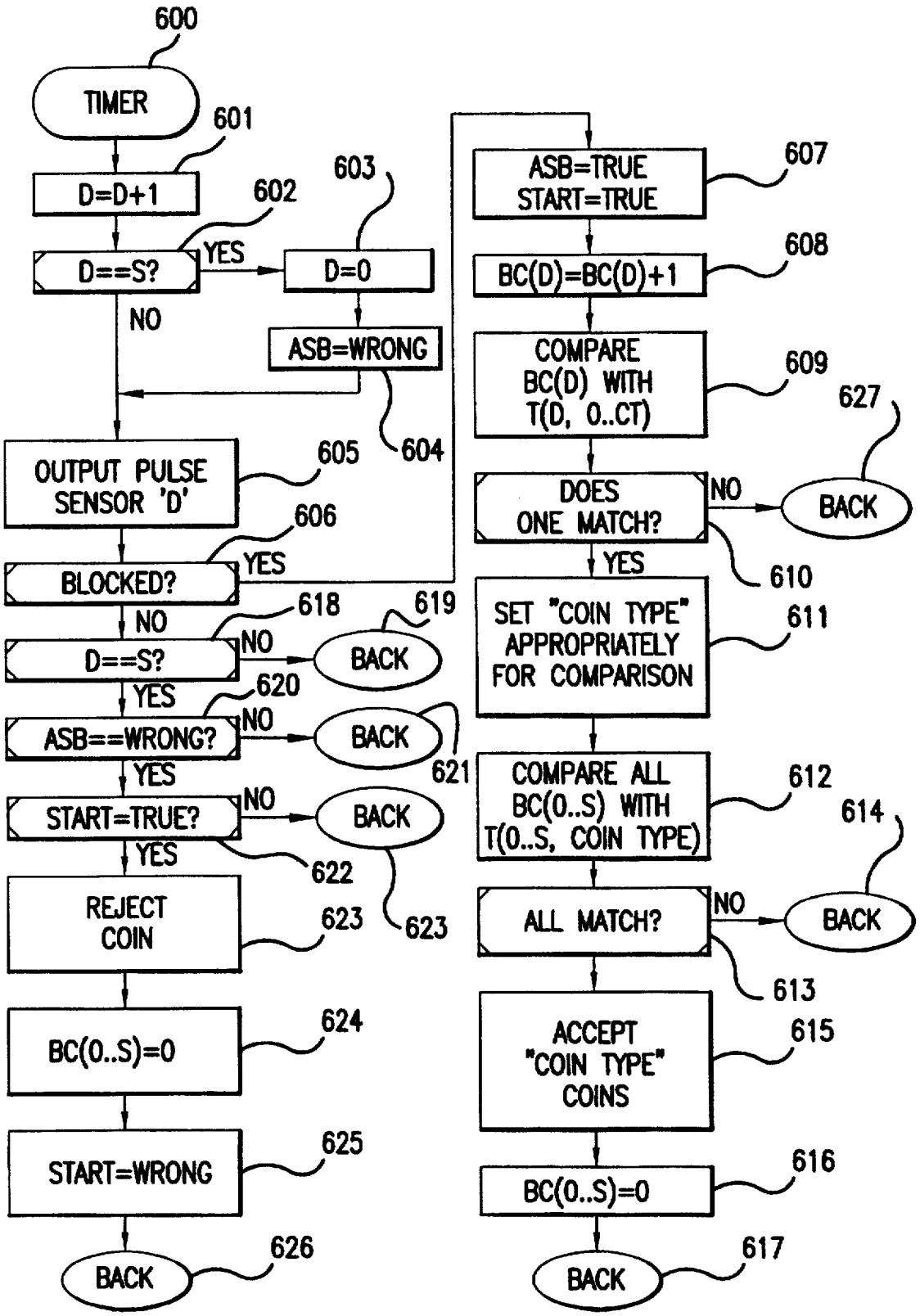

FIG. 6 finally shows a flow diagram of the program-controlled operations for coin recognition in an electronics unit according to FIGS. 3 or 4.

Figure 1:
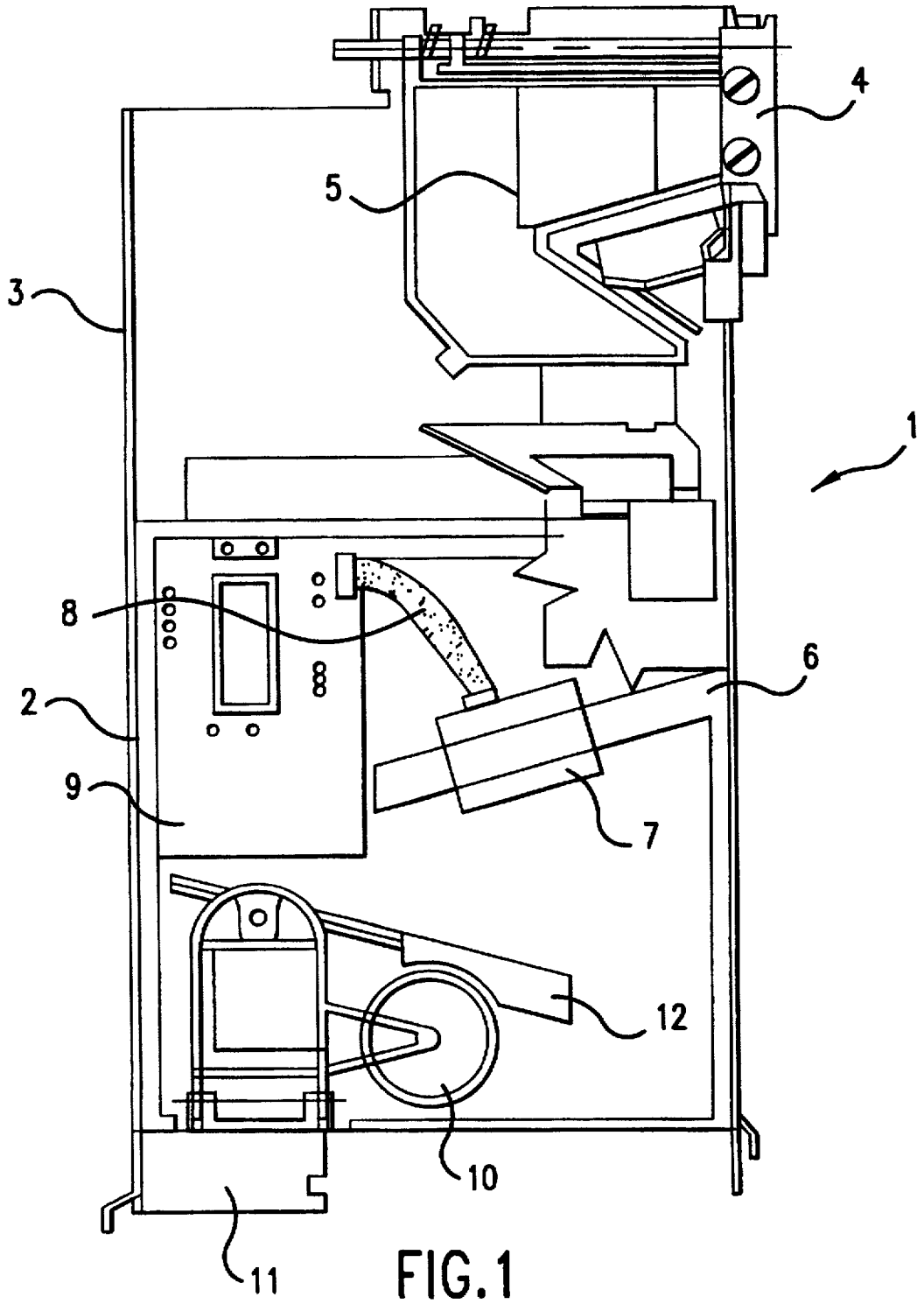

The basic structure of a coin receiver (1) shown in FIG. 1 consists of a lower part (2) on which an upper part (3) can be found. The material used is preferably a special polyethylene which on the one hand has an especially low coefficient of friction and on the other hand combines low weight with long wearing, with the result that noises and vibrations can be reduced compared with models in other known materials. The material may preferably be a fiber glass polycarbonate. A metal casing protects the inner part of the coin receiver.

A coin can be introduced through a coin slot (4) into the interior of the upper part (3), is deflected by an impact plate (5) and falls into the lower part (2) of the coin receiver, where it continues rolling in a chute (6) inclined in a downward direction. The chute is inclined at about 25° to the horizontal, with the result that an especially advantageous, smooth rolling behavior of the coin is achieved.

While rolling downward in the chute (6), the coin is checked by sensors of a sensor unit (7). The sensor unit (7) is connected via a multiple cable (8) to an electronics unit (9) in which the drive pulses for the sensors are generated and the evaluation of the data supplied by the sensors of the sensor unit is carried out. The electronics unit (9) operates a trigger switch (10), by means of which the checked coin is finally deflected either into an escrow box (11) or to a rejection slot (12)—depending on the result of the checking procedure. It is also possible to provide a shaking mechanism, which is not shown and, if one or more coins jam in the chute, produces vibrations which are suitable in a manner known per se, in cooperation with the low-friction material of the chute, for eliminating the jam and allowing the coins to continue rolling.

Figure 2A:
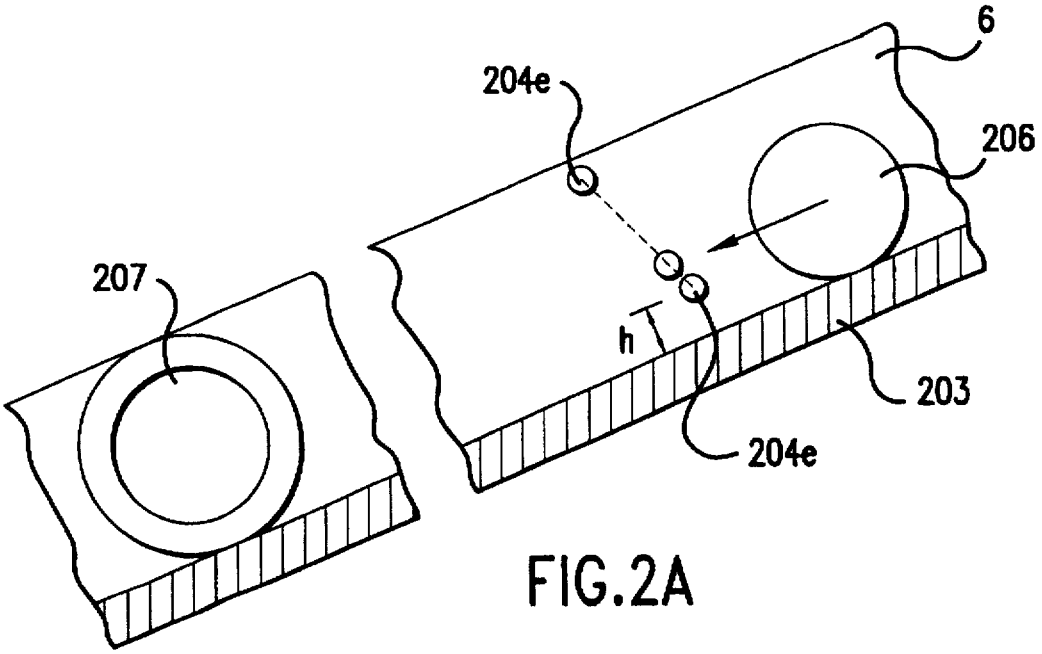
Figure 2B:
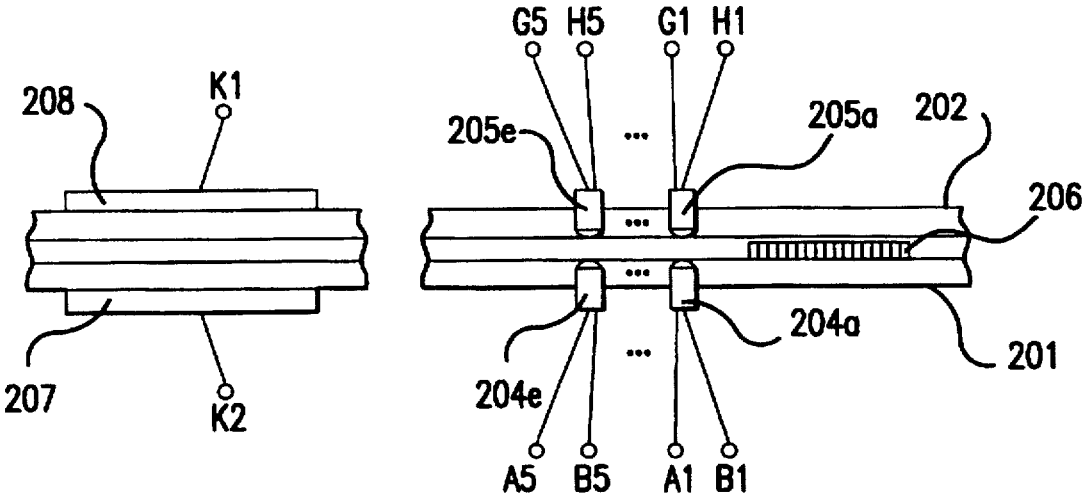

FIG. 2 schematically shows an exemplary embodiment, according to the invention, of the sensor unit (7), FIG. 2*a* showing a side view and FIG. 2*b* a view from above. The chute (7), with side parts (201, 202) and a bottom (203), has an arrangement of at least one optoelectronic transmitter (204*a–e*) and corresponding optoelectronic receivers (205*a–e*), which are arranged in pairs opposite one another and let into the side parts of the chute, so that each pair forms an optical transmission path transversely across the interior of the chute and serves as a sensor. Each transmitter (204*a–e*) is connected to the electronics unit (9) via connections (A1–A5 and B1–B5) and each receiver via connections (G1–G5 and H1–H5). A coin (206) rolling downward in the chute will interrupt certain transmission paths for certain periods, depending on the diameter of the coin. The transmission paths which can be interrupted by a coin depends on the diameter of the coin and on the particular distance h of the transmission path from the bottom (203) of the chute. The sensors are therefore preferably arranged closely adjacent to one another and the distances h are chosen so that, in order to recognize coins of different diameters, said coins each just interrupt one of the transmission paths. If it is intended to recognize, for example, four American coins, the lowest transmission path (204*a*, 205*a*) must be arranged so low that the smallest valid coin (dime) just interrupts said path; hence, all coins having a diameter smaller than that of a dime can be reliably picked out. It would then be necessary for the next largest coin (penny) just to cover the next highest sensor when rolling past—and of course also the lowermost sensor. The distances h of the next highest sensors must be adapted to the diameters of the next largest coins (nickel, quarter). Finally, it is preferable to provide a final sensor which is arranged highest and is no longer covered even by the largest valid coin (quarter), facilitating the reliable recognition of coins which are too large.

The period for which a coin rolling passed interrupts transmission paths of sensors is dependent not only on the diameter of the coin but also on the rolling speed. This in turn is dependent not only on the inclination of the chute and the weight of the coin but essentially also on the friction and the air resistance of the coin in the chute. Consequently, the speed is dependent on the material of the coin, on the design of the edge of the coin and on the image stamped in the surface. By a suitable arrangement of the sensors, it is therefore possible to obtain the number of pulses that are being blocked when the coin passes through the individual sensors which is characteristic of only a very specific type of coin.

In addition to the sensor unit, a capacitive sensor consisting of two plates 207, 208 which form a plate capacitor is also indicated, said sensor being connected to the electronics unit (9) via connections K1 and K2. Such a capacitive sensor for checking coins can be driven, in a manner known per se, by d.c. voltage, either the current change due to a capacitance change being measured or the detuning of an oscillating circuit formed with the capacitor being evaluated.

FIG. 3 shows a block diagram of an exemplary embodiment of an electronics unit (9). A digital signal processing circuit (301), for example a single-chip microcontroller, drives the optoelectronic transmitter (204) via output lines O and signal amplifier (302). The optoelectronic receivers (205) are connected to inputs of the signal processing circuit (301) via signal receivers (303) and input lines I; the trigger switch (10) is operated via a further output line T and via a driver (304). In addition to the optical sensors, a capacitive sensor (207, 208) may be connected at terminals K1 and K2 to a drive and evaluation circuit 306, which is connected to further inputs and outputs of the signal processing circuit (301) via lines K. Communication lines C which may be led to further inputs or outputs of the microcontroller permit reading and storage of information in the microcontroller by running through a suitable protocol. A battery unit (305) provides the operating voltage of the electronics unit.

FIG. 4 shows the circuit diagram of an exemplary embodiment of an electronics unit (9) according to FIG. 3. The microcontroller (301), for example a module of the type Z86E08, generates, on the basis of a resonator X1 (401) connected to connections X1, X2, control pulses which are output via the output lines O led to output connections P20–P24 and are applied via resistances (411–415) to the base terminals of driver transistors (421–425). A series circuit comprising a series resistor (431–435) and an LED (204*a–e*) connected via terminals G1–G5 and H1–H5 and emitting infrared light is connected as an optoelectronic transmitter with the operating voltage (6–12 V) in the collector circuit of each driver transistor.

Figure 5:
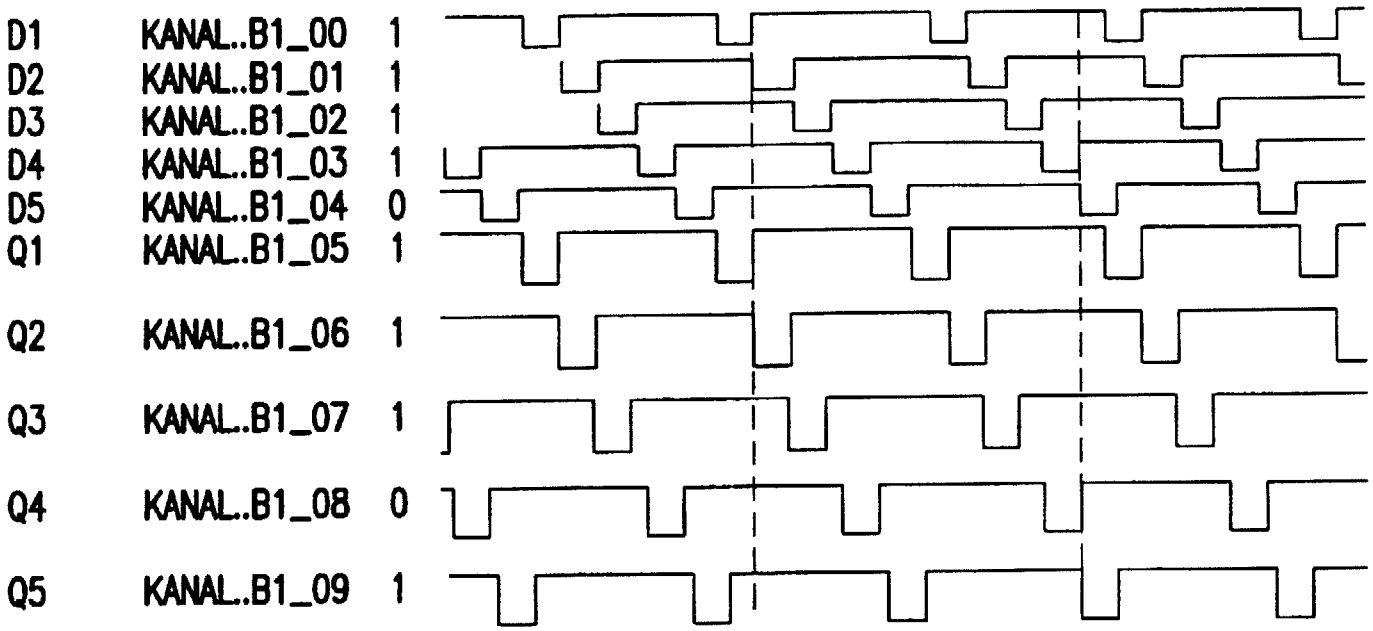

In the time sequence diagrams D1 to D5, FIG. 5 shows a typical pulse pattern of the collector-emitter voltage of the driver transistors (421–425) in which each LED is switched on for a short time—typically a few microseconds—and a short infrared light pulse is thus generated. The timing frequency of these pulses is preferably above 1500 Hz.

The optoelectronic receivers are formed by phototransistors (205*a–e*) which are connected via terminals A1–A5 and B1–B5 and each of which have their emitter connections grounded, the collector connections each being connected with a resistance (441–445) to the positive supply voltage (6–12 V) or being connected via input lines I directly to input connections P26–P27 and P31–33 of the microcontroller (301).

In time sequence diagrams Q1 to Q5, FIG. 5 shows a typical pulse pattern of the collector-emitter voltage of the phototransistors (205*a–e*), each of which patterns exhibits a negative voltage pulse when the corresponding infrared light pulse arrives. Each transmitting pulse of the time sequence diagrams D1–D5 therefore corresponds to a slightly delayed receiving pulse in the time sequence diagrams Q1–Q5.

To check the validity of a coin, the microcontroller counts, separately for each transmission path of the sensor unit, the number of light pulses emitted at equal time intervals which are interrupted by the coin rolling past. This is effected by determining the number of transmitting pulses to which no receiving pulses correspond. The numerical series of blocked pulses of each sensor, which series is thus characteristic of each individual coin rolling past, is compared in the microcontroller with reference values for each coin type defined as valid. Where there is sufficiently good agreement with one of the reference values, the coin is recognized as valid and is accepted.

For this purpose, a drive coil (450) of the trigger switch (10) is driven by the microcontroller via a driver circuit (451–453) and via an output line connected to the terminal P25, with the result that the coin can fall into the escrow box (11). If the numerical series of the blocked pulses is outside the tolerance bands of all valid coins, the coin is rejected and is deflected by the trigger switch, which is now not driven, into the rejection slot (12).

The processing steps carried out in the signal processing circuit (301) may be divided into the single (possibly even unique) training phase for determining the reference values for all coins regarded as valid and into the operating phase for checking inserted coins.

In a training process, which may be controlled, for example, via the communication lines C, valid coins are inserted in succession as reference coins. A setpoint value for the number of blocked pulses of each sensor can thus be determined for each valid coin type by counting the pulses blocked at each sensor. These setpoint values are stored in a nonvolatile memory located in the microcontroller or in a battery-backed volatile memory.

Owing to the different distances of the sensors from the bottom of the chute, which distances are adapted to the coin diameters, the coding of the information with regard to the diameter of a coin is effected essentially by determining which of the sensors are actually blocked by the coin rolling past. All further information relating to the distinguishing of coins of about the same diameter are coded in the setpoint values for the number of interrupted pulses for each sensor.

At the end of the training series, a set of reference values for the number of blocked pulses of each sensor is stored in the memory for each valid coin type.

During operation, when a coin rolls through the sensor unit, the number of blocked pulses is counted for each sensor and compared in a comparison phase with the reference numbers for all valid coin types. If there is sufficiently good agreement with a set of reference values for a certain coin type, the coin is recognized as belonging to this coin type and is accepted. The coin value can be summed in an accumulator.

FIG. 6 shows a detailed flow diagram for the recognition of the coins:

The meanings are as follows:

S: Number of sensors (sensors 0 to S-1)

D: Serial number of the sensor currently being checked

BC(D): Counter for the number of blocked pulses for the sensor D [blocked counter]

CT: Number of different valid coin types+1

COINTYPE: Type of coin (0 to C)

T(D,CT): Reference value of blocked pulses for sensor D and coin type CT

ASB: Flag; true when any sensor has been recognized as being blocked in the current test cycle [any sensor blocked]

START: Start; true when any coin has been detected in the sensor unit.

A timer (600) triggers a program run of the detection program with a repeat rate so there is an interrogation frequency for each sensor of about 1500 Hz, i.e. if "S" sensors are present the program run must be activated by the timer with the frequency 1500 Hz * S. First, the number "D" of the currently active sensor is increased (601) and, when the final sensor has responded (602), a new sensor test cycle is begun again with the first sensor (603) and a flag (ASB) (any sensor blocked) is set to false (604). A pulse is output (605) via the output lines O for the currently active sensor "D" and hence a light pulse is transmitted transversely across the chute (7). The further program sequence is dependent on whether the light beam of the sensor is blocked by a coin (606):

If the light beam is interrupted, this is recorded for the current sensor interrogation cycle by setting "ASB" and for the currently checked coin by setting a flag "START" (607) and a pulse counter "BC" (blocked counter) for the current sensor is increased (608), the number of pulses blocked directly one after the other being accumulated in the pulse counter "BC". If a comparison of the pulse counter "BC(D)" for the current sensor "D" with the reference values "T(D,0 . . . CT)" stored for the relevant sensor in a nonvolatile memory for all possible coins 0 . . . CT (coin type) (609) found to be correct shows that any of the reference values T(D,COINTYPE) fits (610), the actual coin type "COINTYPE" is thus determined (611); if not, the program run for the current counter is ended (627). In order actually to be able to accept the coin as a "COINTYPE" type, it is of course also necessary for the number of blocked pulses for all other sensors to agree with the corresponding reference values for the relevant coin; this comparison is carried out in the following blocks (612) and (613). If one of the sensors still has a number differing from the reference value, the program run is ended (614) and—after the defined delay time—the next sensor is thus activated. However, if the counter values "BC(" of all sensors fit the reference values TC( ,COINTYPE), the coin is accepted as a valid coin of the type "COINTYPE" (615), the trigger switch (10) is operated so that the coin falls into the escrow box (11) and the coin value is accumulated in an accumulator. Furthermore, the counters "BC" of all sensors are reset (616) and the program run is ended (617). If a capacitive sensor (207, 208) is used in addition to the optical sensor, for final acceptance of the coin the capacitance value determined with the aid of the drive and evaluation circuit (306) must also agree sufficiently exactly with the setpoint capacitance value of the coin type. This comparison is preferably carried out as an additional process step in function block 612.

If the light beam of the current sensor has been recognized in the comparison block (606) as not being blocked, i.e. a pulse has been read via the input line I corresponding to the particular output line O, because the corresponding phototransistor (205) was able to receive the light pulse, the program run is ended if the current sensor was not the final sensor (618, 619) if at least one of the sensors was blocked in the current sensor interrogation cycle (620, 621) or if no coin has as yet been inserted or it has not yet blocked a sensor (622, 623). However, if any sensor has been blocked by the checked coin, but all sensors are free again in the current sensor interrogation cycle, i.e. if the coin has passed the sensor unit without it being possible to detect agreement with one of the reference coins, the coin is rejected (623) and the test cycle for the next coin is begun completely anew by resetting all counters (624), resetting the START flag (625) and ending the program run (626).

I claim:

1. Method for recognizing permitted coins rolling along a sloping chute with:

a) a learning step in which at least one classifying property of reference coins is determined without contact and is stored in the form of at least one characteristic value, b) determining at least one property of the coins to be investigated, whereby comparison values comparable to the characteristic values can be determined, c) comparing at least one comparison value with a corresponding characteristic value, d) dividing the investigated coins into classes of permitted and prohibited coins according to the result of the comparison, characterized in that pulsed radiation in the visible or invisible range is directed transversely to the rolling direction of the coins in at least one point of the chute by a light barrier (204, 205) and a property of a reference coin or a coin to be investigated is determined by counting pulses.

2. Method according to claim 1, characterized in that by counting the pulses sent but not received, a passage time during which the coin blocks the beam path is determined.

3. Method according to claim 1 characterized in that the radiation is generated by an infrared transmitter (204) and received by an infrared receiver (205).

4. Method according to claim 1, characterized in that a pulse frequency of at least 1000 Hz, in particular 1500 Hz, is chosen.

5. Method according to claim 1 characterized in that at least two light barriers (204, 205) are disposed at various distances from the rolling surface (203) of the chute (6) and pulses are counted at the two light barriers (204, 205) to determine characteristic values or comparison values, preferably passage times.

6. Method according to claim 3, characterized in that the velocity at which the coin moves along the chute (6) is determined in the vicinity of at least one light barrier (204, 205).

7. Method according to claim 6, characterized in that at least one first and one second light barrier (204, 205) are disposed at equal distances from running surface (203) of chute (6) and in that, for velocity measurement, the time between the blocking of the first and the blocking of the second light barrier (204, 205) and/or between the clearing of the first and the second light barrier (204, 205) is preferably determined by counting the pulses that are blocked at only one of the two light barriers (204, 205).

8. Method according to claim 6 characterized in that the coin diameter is calculated based on blocking time $t_1$, as the coin runs through, determined by at least one first light barrier (204, 205) at a height $h_1$ above the running surface (203) and the velocity v determined in the vicinity of the first light barrier (204, 205) as well as the height $h_1$, with the coin diameter D preferably being calculated as $D=h_1+v^2 \cdot t_1^2/4h_1$.

9. Method according to claim 7, characterized in that the velocity of the coin is determined as the average value of at least two velocity determinations preferably carried out at the front and the rear coin edges and, if required, an acceleration is determined from the velocity measurements carried out at different times.

10. Method according to claim 1 characterized in that in order to determine characteristic values or comparison values, the change in capacitance of at least one capacitor (207, 208) having capacitor plates disposed on both sides of chute (6) is measured.

11. Method according to claim 10, characterized in that capacitor (207, 208), as part of an oscillating circuit, unbalances a periodic signal during passage of the coins.

12. Method according to claim 11, characterized in that the periodic signal is a square wave having a frequency of more than 1000 Hz, preferably about 1500 Hz.

13. Method according to claim 5 characterized in that depending on the coins that have to be distinguished, the light barriers (204, 205) are disposed at distances from the running surface (203) that are just less than and/or greater than the diameters of the coins to be distinguished.

14. Method according to claim 2 characterized in that, for classification of a coin, the times of passage at all light barriers (204, 205) are compared with the times of passage characteristic for permitted coins at the corresponding light barriers (204, 205), and the coin is assigned to a class when the deviations of the individual times of passage are within predetermined tolerances.

15. Method according to claim 14, characterized in that the face value of a coin that was assigned to a class is summed in an accumulator.

16. Method according to claim 1 characterized in that a separation step is provided following the chute (6) in which step coins that have not been assigned to any desired coin class are separated from the desired coins by means of a deflector switch (10).

17. Method according to claim 2 characterized in that, in order to determine characteristic times of passage, a training phase is provided in which permitted coins pass through the chute (6) as reference coins, and the times of passage determined for the coins are stored as reference values and/or are statistically evaluated in order to store derived values.

18. Coin differentiation device for recognizing permitted coins with a chute (6) having a rolling surface (203), an electronics unit (9), and a sensor unit (7) connected therewith, which comprises at least one light barrier (204, 205), whereby light barrier (204, 205) is associated with chute (6) and makes a value dependent on a coin rolling through chute (6) past light barrier (204, 205) determinable, characterized in that light barrier (204, 205) is operable with pulsed radiation and electronics units (9) is designed to count pulses of radiation, particularly pulses of radiation blocked by a coin.

19. Coin differentiation device according to claim 18, characterized in that light barrier (204, 205) is operable at a frequency of at least 1000 Hz, but in particular essentially 1500 Hz.

20. Coin differentiation device according to claim 18, characterized in that the electronics unit makes the blocking time of light barrier (204*a–e*, 205*a–e*) or the passage time of the coin determinable by counting the blocked radiation pulses.

21. Coin differentiation device according to claim 18, characterized in that at least one light barrier (204, 205) has at least one infrared transmitter (204) and at least one infrared receiver (205).

22. Coin differentiation device according to claim 18, characterized in that at least two sensors are designed as light barriers (204*a–e*, 205*a–e*).

23. Coin differentiation device according to claim 22, characterized in that light barriers (204*a–e*, 205*a–e*) are disposed at different distances from rolling surface (203) preferably such that the diameter of a permitted coin is only slightly smaller or larger than the distance between a light barrier and the rolling surface (203).

24. Coin differentiation device according to claim 18, characterized in that electronics unit (9) has a processor (301) which operates at least one light barrier (204*a–e*, 205*a–e*) making possible determination, storage, and reading of characteristic values and comparing same with actual values and controls a deflecting device (10) for separating prohibited and permitted coins.

25. Coin differentiation device according to claim 18, characterized in that sensor unit (7) has at least one capacitor (207, 208) with capacitor plates on both sides of chute (6).

26. Coin differentiation device according to claim 25, characterized in that capacitor (207, 208) is associated with an oscillating circuit that can be unbalanced by capacitor (207, 208) when a coin passes through.

27. Coin differentiation device according to claim 26, characterized in that a periodic signal with a frequency of at least 1000 Hz but preferably approximately 1500 Hz can be supplied to the oscillating circuit.

28. Coin differentiation device according to claim 18, characterized in that chute (6) is inclined by more than 10°, preferably approximately 25°, from horizontal.

29. Coin differentiation device according to claim 18, characterized in that feeder device (3) and/or chute (6) and/or deflection device (10) consists essentially of plastic, preferably of low-density polyethylene, but possibly of polyamide or polyester.

30. Coin differentiation device according to claim 18, characterized in that feed device (3) comprises a brake device from which the coins can be delivered at an essentially predetermined velocity into chute (6).

31. Coin differentiation device according to claim 18, characterized in that feed device (3) comprises an impact plate (5) for deflecting the inserted coins.

32. Coin differentiation device according to claim 19, characterized in that the electronics unit comprises an accumulator in order to sum the face values of the permitted coins during their insertion process.

* * * * *